United States Patent [19]

Moroni

[11] 4,421,793

[45] Dec. 20, 1983

[54] SELECTIVE GALVANIZING PROCESS USING A CALCIUM CARBONATE MASKING COMPOSITION

[75] Inventor: Ermes Moroni, Bresso, Italy

[73] Assignee: Hodigal s.a.s. di Luciano Moroni, Milan, Italy

[21] Appl. No.: 375,464

[22] Filed: May 6, 1982

Related U.S. Application Data

[62] Division of Ser. No. 169,602, Jul. 17, 1980, abandoned.

[30] Foreign Application Priority Data

Jul. 24, 1979 [IT] Italy ..... 24600 A/79
Dec. 21, 1979 [IT] Italy ..... 28352 A/79

[51] Int. Cl.[3] ..... B05D 1/32

[52] U.S. Cl. ..... 427/272; 427/282; 427/300; 427/310; 427/321; 427/433; 427/398.1

[58] Field of Search ..... 427/300, 321, 433, 272, 427/282, 259, 310, 313, 398.1; 106/306; 252/99; 423/165, 430

[56] References Cited

U.S. PATENT DOCUMENTS 3,121,019 2/1964 Blay ..... 427/300
4,047,977 9/1977 Yoshida et al. ..... 427/300 X

*Primary Examiner*—John D. Smith
*Assistant Examiner*—Bernard F. Plantz
*Attorney, Agent, or Firm*—Henry R. Lerner

[57] ABSTRACT

This invention relates to a process of selective galvanizing of materials adapted to be galvanized by immersion in hot conditions characterized by the application on said materials, prior to immersing them into a bath of melted zinc, on those spots on which no galvanizing is desired, calcium carbonate alone, or a mixture thereof with an alkali metal chlorinated-s-triazine trione, or with an alkali metal salt of an oxygen-containing chlorine compound.

13 Claims, No Drawings

SELECTIVE GALVANIZING PROCESS USING A CALCIUM CARBONATE MASKING COMPOSITION

This is a division of application Ser. No. 169,602 filed July 17, 1980, now abandoned.

As is well known, in the galvanizing processes by immersion in melted zinc, the metallic material to be protected, which is generally common steel or iron, is immersed, after an appropriate preliminary treatment, in a bath of melted zinc for the time which is necessary to built up an appropriate coating of the protective metal.

The formation of an adherent coating layer on the backing material is due to the establishment of a metal bond between iron and zinc, which thus make up an alloy which is responsible for the bonding of the protective coating to the surface of the backing material. Pure zinc is then deposited on such alloy so that the thickness of the protective layer is increased.

In order that the so-called wettability of the metal to be coated by melted zinc may be improved, thus exalting the adhesion of the coating film, a preliminary treatment is carried out, which generally comprises the steps of subjecting the surface of ordinary steel to defatting and pickling, followed by an application of a flux, in order that the as-formed oxides may be removed. It is fitting to note that in the processes of galvanization by immersion in hot zinc bath according to the prior art, the protective zinc coating is extended over the entire surface of the workpiece immersed in the bath, without masking any area of the metal surface. It would be highly desirable, conversely, to have a selective galvanizing method available, capable of properly masking from the protective zinc coating certain surface areas of the workpiece to be galvanized and, above all, those areas which are intended to be subsequently machined, or soldered for the most varied tachnical reasons.

It is apparent that galvanizing of those areas which actually need not be galvanized is a zinc waste and thus an added cost, the subsequent machining operations being furthermore complicated thereby.

An object of the present invention is to solve the above outlined problem in connection with the conventional technology of galvanizing by immersion in molten zinc.

Another object of the invention is to solve such a problem by a selective galvanizing process which is economically acceptable and is simple to perform in practice. In the first place, it is desired to dispense with using intricate and costly machinery to be expressely designed and constructed therefor.

Having these considerations in mind, it has now surprisingly been found that the application of calcium carbonate on certain areas of the material to be so galvanized satisfactorily prevents the formation of the Fe-Zn alloy and thus a stable bond of the zinc coating to such areas.

According to the invention, it has been ascertained that the mere application of calcium carbonate on the material to be galvanized by hot zinc melt immersion is sufficient to impede the formation of the Fe-Zn bonding alloy.

It has also been ascertained, however, that this effect of zinc bond prevention is still more advantageously and satisfactorily achieved, as compared with the mere application of calcium carbonate, by applying such calcium carbonate in admixture with a chlorine-containing compound on the areas intended to be masked from the galvanizing action.

In order that the above specified objects may be achieved, the present invention suggests a selective galvanizing process by immersion in a molten zinc bath, said process being characterized by the application to the areas to be masked of a product containing calcium carbonate, $CaCO_3$, prior to the immersion of the material concerned in the molten zinc bath.

According to a first embodiment of the process of this invention, said product is exclusively composed by calcium carbonate.

According to an alternative embodiment, the product in question consists of calcium carbonate and a compound which contains chlorine, selected from the group consisting of an alkali metal chlorinated-s-triazine trione, an alkali metal salt of an oxygen-containing chlorine compound having an oxidation number equal to or grater than 1.

Examples of oxygen-containing chlorine compounds as defined above are the hypochlorites, the chlorites, the chlorates and the perchlorates.

Preferably, the percentages, on a weight base, of the admixture are from 60% to 99.9% of $CaCO_3$ and from 40% to 0.1% of the chlorine-containing compound as hereinbefore defined.

According to a possible embodiment of the invention, and in more detail, the process as outlined above comprises the steps of preliminary treating the material, to be galvanized in a selective manner according to this invention, that is, defatting of the workpiece in hot solvents, washing, pickling and application of a zinc and ammonium chloride flux. Subsequently, the product according to this invention is applied to the surface areas to be masked, after a workpiece preheating if necessary or expedient, and the workpiece is finally dried.

The masking composition, which has generally the appearance of a powder, is generally, but not compulsory, used in solution (generally an aqueous solution), in proportions which can be varied consistently with the several operational conditions. The application of the aqueous solution of the product to the material to be treated can be carried out by spraying, sweeping, wetting, dipping or filling.

The product can, however, be applied also as such in the solid state.

According to another embodiment of the invention, the application of the product in question is effected on the material to be subjected to selective galvanizing after that it has been conventionally pre-treated but without fluxing the areas intended to be masked.

According to still another possible embodiment of the invention, the preliminary treatment of the surfaces to be galvanized can be provided. In such a case, then, the application of the product in question is directly made on the surface to be masked without any preliminary treatment of same.

Subsequently to the application of the product according to the invention, the material to be selectively galvanized is immersed in the molten zinc bath according to the conventional practice.

The time of stay of the material in the molten zinc bath does not influence the masking power of the product, so that the time remains that which is required for a complete and satisfactory galvanizing of the areas to be zinc-coated.

Once the necessary immersion time has elaspsed, the material is removed from the molten zinc bath. During this step, a portion of the surfaces which have been treated with said product, that is the areas to be masked, could anyhow but not necessarily appear coated by a zinc layer. This deposition is attributable to the mechanical adhesion of the liquid zinc to the exiting material. In order that this zinc coating which adheres frictionally may be removed, operations are carried out which encourage the unsticking of zinc, such as, for example, the immersion in a liquid, such as water, at a temperature which can also be above room temperature. By so doing, the zinc which possibly adhered mechanically to the masked surfaces, is detached both due to heat shock and the mechanical action of the liquid. This cooling operation, which can be carried out by immersion, spraying, shower, filling, sweeping or contact, can be accompanied, or replaced, by a mechanical brushing of the surfaces to be masked.

Consistently with the shape of the material subjected to such a treatment, the operation of removing the zinc possibly adhering to the masked surfaces, as outlined above, can be substituted, or accompanied, by injection of compressed air or steam impinging onto the surface simultaneously with, or subsequently to, the removal of the workpiece from the zinc bath. The zinc so removed from the masked surfaces can be collected and recovered separately with a screening procedure and subsequently dried and preheated prior to being fed back to the zinc melt bath again.

In order that the process according to the invention, which has been outlined hereinabove in connection with its main features, may be better understood, a few practical examples will be given hereinafter.

It is understood that these examples are to be construed as non-limiting of the scope of the invention as described herein. In this connection, it is stated herein that any kind of materials which lend themselves to the conventional galvanizing by immersion in a zinc melt can be treated according to the process of this invention, irrespective of its shape and size, and that the particular workpieces as described in the examples to follow can be treated with advantage with a process of selective galvanizing according to the present invention, even if different from the one specifically mentioned in the example concerned.

EXAMPLE 1

A cylindrical reservoir having crowned head walls fitted with fluid inlet and outlet passageways, made with usual metal sheet is to be subjected to selective galvanizing.

The reservoir in question is treated according to the following sequence of working steps:

- dipping in an alkaline defatting solution (Hot, 85° C.) for about 10 to 15 minutes (defatting);
- rinsing in neutral running cold water (washing); dipping in an acidic solution (about 17% HCl) in the cold, for about 20 minutes (pickling);
- rinsing in cold running water, neutral (washing);
- immersion in a solution of 30° Bé of zinc and ammonium chloride, in the hot (60° C.) for about 3 to 5 minutes (fluxing);
- application of a shower of an aqueous solution of calcium carbonate (90%) and sodium hypochlorite (10%) into the entire outer surface of the reservoir, allowing to drain for a while;
- drying and preheating in an air-circulation oven at about 100° C. for about 20 minutes;
- complete immersion in molten zinc at a velocity of 1 meter per minute and stay in the bath for about 3 minutes;
- removal from the molten zinc at a velocity of 1 meter per minute;
- immersion and cooling in water for about 30 seconds;
- brushing the outer surface to remove the stuck on zinc.

The reservoir so treated appears to have been correctly galvanized on its interior surface and not galvanized on the 90% or more of its external surface.

As the reservoir is removed from the zinc melt bath, the outer surface appears coated by a dust, which is the reaction product or sublimation product or fusion product of sodium hypochlorite and calcium carbonate, to which pure metallic zinc is stuck, which extends along 50% to 70% of the surface. On completion of cooling, by immersion in water, the zinc which adhered by friction is unstuck nearly entirely together with said white dust which then passes nearly completely in solution.

The surface which is still coated by stucking zinc is mechanically brushed until removing said zinc from the masked surfaces completely.

EXAMPLE 2

A planar metal sheet is subjected to selective galvanizing. The metal sheet is treated according to the following step sequence:

- immersion in a hot alkaline defatting solution (85° C.) for about 10 to 15 minutes (defatting);
- rinsing in neutral cold running water (washing);
- immersion in an acidic solution (17% HCl) in the cold for about 20 minutes (pickling);
- rinsing in cold neutral running water (washing);
- application by spraying or sweeping, on the surface of the sheet metal to be galvanized, of a solution of about 30% Bé of zinc and ammonium chloride, in the hot (60° C.) for about 3 to 5 minutes (fluxing);
- application by spraying or sweeping on the surface of the sheet metal which is not to be galvanized (masked), of an aqueous solution of sodium hypochlorite (10% wt) and calcium carbonate (90%) allowing the solution to drain for a short time;
- drying and preheating in an air-circulation oven at 100° C. approx. for about 20 minutes;
- complete immersion in molten zinc at a velocity of 1 meter per minute and stay in the bath for about 3 minutes;
- removal from the zinc melt bath at the velocity of 1 meter per minute;
- immersion and cooling in water for about 30 seconds;
- brushing of the external surface for removing the adhering zinc.

The metal sheet so treated appears to have correctly been galvanized on the fluxed surface, and non-galvanized on the 90% of the masked surface. At the instant of removal from the zinc melt, the surface which had been treated with the product according to this invention was coated by a dust which was the product of the reaction, or sublimation, or fusion of sodium hypochlorite and calcium carbonate to which stuck pure metallic zinc which extended over about 50% to 70% of the surface concerned.

On completion of cooling by immersion in water, the metallic zinc is detached nearly completely and the white powder aforesaid disappears, as it has passed nearly entirely in solution. The surface portion which still appears to be zinc-coated is mechanically brushed so as to achieve a complete removal.

EXAMPLE 3

A pipe section is subjected to selective galvanizing.

The pipe is treated according to the following step sequence:

- filling the pipe interior with a hot (85° C.) alkaline defatting solution for about 10 to 15 minutes (defatting);
- rinsing the pipe interior with cold neutral running water (washing);
- filling the pipe interior with a cold acidic solution of 17% HCl for about 20 minutes (pickling);
- rinsing the pipe interior with cold neutral running water (washing);
- filling the pipe interior with a hot (60° C.) solution of 30° Bé of zinc and ammonium chloride for about 3 to 5 mins.(flushing);
- application by immersion or sweeping, to the pipe exterior, of the aqueous solution of calcium carbonate (90% wt) and sodium hypochlorite (10% wt) so as to treat the entire outer surface of the pipe section;
- drying and preheating in an air circulation oven at about 100° C. for about 20 minutes;
- complete immersion in molten zinc at a velocity of 1 meter per minute and stay in the bath of about 3 minutes;
- removal from the zinc melt bath at a velocity of 1 meter per minute;
- immersion and cooling in water for about 30 seconds;
- brushing of the outer surface to remove the zinc adhered thereto.

The pipe section so treated appears to have correctly been galvanized in its interior and non-galvanized over the 90% of its external surface.

At the instant of removal from the zinc melt, the outer surface appeared to be coated by a white dust, i.e. the product of reaction, or sublimation, or fusion of sodium hypochlorite and calcium carbonate onto which pure metallic zinc adheres and extends over about the 50% to 70% of the surface concerned.

Once the cooling by immersion has been completed, the metallic zinc is nearly completely unstuck and the white dust disappears as it has been nearly entirely solubilized.

The surface which is still zinc-coated is mechanically brushed so as to achieve a complete removal of the zinc from the surface which had been masked.

EXAMPLE 4

EXAMPLE 1 is repeated by adopting for the masking stage an aqueous solution of $CaCO_3$ (about 99% wt) and sodium chlorinated-s-triazine trione (about 1% wt).

EXAMPLE 5

EXAMPLE 2 is repeated by using in the masking stage an aqueous solution of $CaCO_3$ (90% wt approx.) and sodium chlorinated-s-triazine trione (10% wt approx.).

It is stated that the results which have been obtained with the selective galvanizing process described above (in dry conditions) are the same as obtained with procedures which do not effect defatting and use sulphuric acid.

From the foregoing disclosure and Examples it is apparent that the application of the chemical products suggested by this invention permits to perform a selective zinc-melt galvanizing which is absolutely advantageous and permits to achieve the objects indicated in the introductory portion of this specification.

As regards the mechanism of the reaction on which the process of the invention is based, it is pointed out herein that it is still now a subject of investigation. It is surmised that the lack of chemical bond of zinc to steel in the areas which have been treated with the products according to the invention, and thus the resultant impossibility of the formation of the Fe-Zn alloy, is attributable to the formation of a calcium oxide film and other compounds, which become interposed as a chemically inert layer between the steel surface and the zinc melt.

The use of an alkali metal chlorinated-s-triazine trione as compared with that of a salt of an oxygen-containing chlorine compound appears to be preferable due to the better results which can be obtained therewith when the concentration of the triazine compound in admixture with $CaCO_3$, is the same. However, an alkali metal chlorinated-s-triazine trione is expensive and, moreover, it has the defect of being chemically unstable, so that it will become preferable to use, for example, an alkali metal hypochlorite whenever it is desired to have a less expensive end product and no problems of handling and storage are desirable.

I claim:

1. A process for selectively galvanizing a material adapted to be galvanized by immersion in a hot zinc melt, said process comprising:

applying to said material, prior to said galvanizing, in the areas which are to be masked from said galvanizing action a composition consisting essentially of:

about 60% to 99.9% by weight calcium carbonate and about 40% to 0.1% by weight of a chlorine containing compound.

2. Process according to claim 1, characterized in that said chlorine-containing compound is an alkali metal chlorinated-s-triazine trione.

3. Process according to claim 2, characterized in that said compound is sodium chlorinated-s-triazine trione.

4. Process according to claim 1, characterized in that said compound is an alkali metal salt of an oxygen-containing chlorine compound having a number of oxidation equal to, or greater than 1.

5. Process according to claim 4, characterized in that said compound is sodium hypochlorite.

6. Process according to claim 4, characterized in that said salt is a member selected from the group consisting of chlorites chlorates and perchlorates.

7. A process according to claim 1 further comprising:

dissolving or dispersing said composition in a solvent or dispersant therefor, prior to applying said composition to said material and applying said composition to said material as a dispersion or solution.

8. A process according to claim 7 wherein said solvent or dispersant is water.

9. A process according to claim 1 further comprising:

subjecting said material, prior to applying said composition, to the steps of defatting, washing, pickling and fluxing.

10. A process according to claim 9 wherein fluxing the surface to be galvanized is the only treatment on said material prior to applying said composition.

11. A process according to claim 1 consisting of:

subjecting the surface to be galvanized of said material, prior to applying said composition, to the steps of defatting, washing, pickling and fluxing.

12. A process according to claim 1 further comprising the sequential steps of:

(a) drying and preheating the material to which said composition has been applied;

(b) completely immersing the material of step (a) in a zinc melt until a protective layer has been formed on said material;

(c) removing the material of step (b) from the zinc melt;

(d) cooling the material of step (c) and (e) removing from the material of step (d) the zinc sticking to the areas to which said composition has been applied.

13. A process for selectively hot galvanizing a workpiece having areas which must be masked to prevent zinc adhesion to said areas comprising:

applying to said workpiece in the areas which must be masked prior to said galvanizing a composition comprising:

60% to 99.9% by weight of calcium carbonate and 0.1% to 40% by weight of a chlorine containing compound, said composition being characterized by forming substantially water soluble products while immersed in hot melted zinc and substantially preventing the formation of an Fe-Zn alloy normal to said hot galvanizing on said surface areas.

* * * * *